US006125651A

United States Patent [19]

Tack et al.

[11] Patent Number: 6,125,651

[45] Date of Patent: Oct. 3, 2000

[54] AIR-CONDITIONING SYSTEM ACCUMULATOR AND METHOD OF MAKING SAME

[75] Inventors: Jerry A. Tack, Troy; Daniel F. Kiblawi, Farmington Hills, both of Mich.

[73] Assignee: Automotive Fluid Systems, Inc., Troy, Mich.

[21] Appl. No.: 09/046,344

[22] Filed: Mar. 23, 1998

[51] Int. Cl.[7] ..... F25B 43/00

[52] U.S. Cl. ..... 62/503; 62/474

[58] Field of Search ..... 62/503, 512, 474; 29/DIG. 890.06

[56] References Cited

U.S. PATENT DOCUMENTS

| | | | |
|---|---|---|---|
| 4,100,762 | 7/1978 | Davis et al. . | |
| 4,182,136 | 1/1980 | Morse . | |
| 4,354,362 | 10/1982 | Schumacher et al. | 62/474 |
| 4,429,544 | 2/1984 | McCarty . | |
| 4,651,540 | 3/1987 | Morse | 62/503 |
| 4,675,971 | 6/1987 | Masserang . | |
| 4,768,355 | 9/1988 | Breuhan et al. | 62/503 |
| 4,800,737 | 1/1989 | Smith et al. | 62/503 |
| 4,827,725 | 5/1989 | Morse . | |
| 5,075,967 | 12/1991 | Bottum | 29/890.06 |
| 5,179,780 | 1/1993 | Wintersteen et al. . | |
| 5,184,480 | 2/1993 | Kolpacke . | |
| 5,191,775 | 3/1993 | Shiina et al. . | |
| 5,375,327 | 12/1994 | Searfoss et al. | 29/890.06 |
| 5,419,157 | 5/1995 | Kiblawi et al. | 62/503 |
| 5,651,266 | 7/1997 | Hutchison et al. | 62/474 |
| 5,692,394 | 12/1997 | Ozaki et al. | 62/509 |

*Primary Examiner*—Henry Bennett
*Assistant Examiner*—Melvin Jones
*Attorney, Agent, or Firm*—Vanophem Meehan & Vanophem, P.C.

[57] ABSTRACT

An accumulator and a method of manufacturing same for use in an air-conditioning system wherein the accumulator is manufactured having a seamless housing and a cartridge that incorporates an inlet passage, an outlet passage and a baffle member into an integral cartridge which is inserted in an open end of the housing during production and secured in place by clips caught by a shoulder formed in the housing. A connector is used to complete the outlet passage of the cartridge of the accumulator. The open end of the housing is spun-closed shut to provide a nearby seamless accumulator. In an alternative embodiment the housing is manufactured to have an open end and a closed end and a disk having inlet and outlet holes is welded or brazed to the open end.

29 Claims, 4 Drawing Sheets

FIG-5
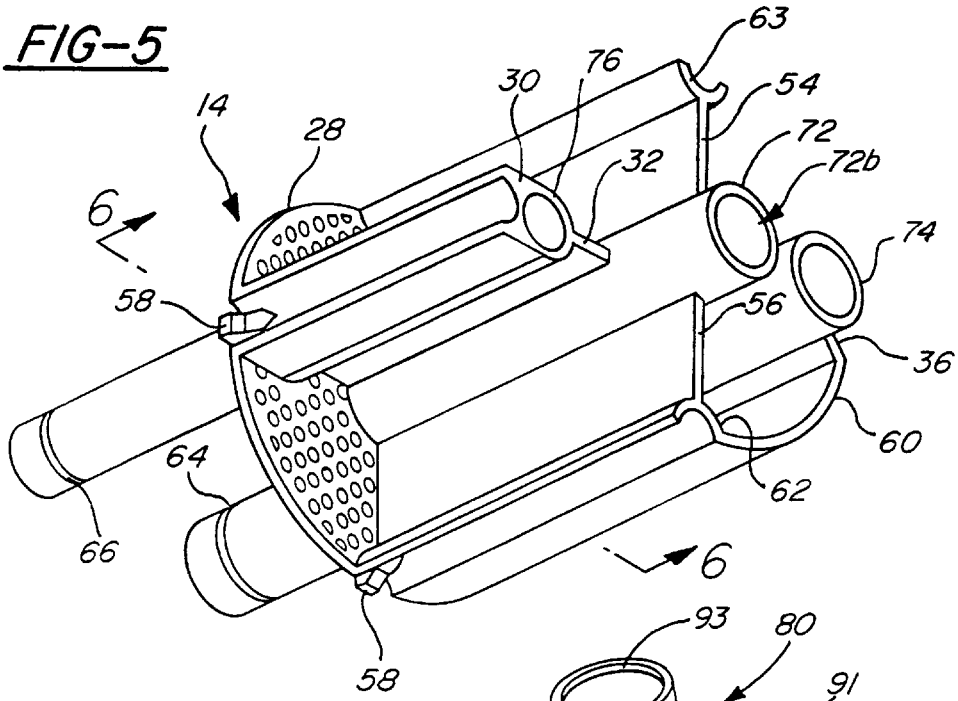
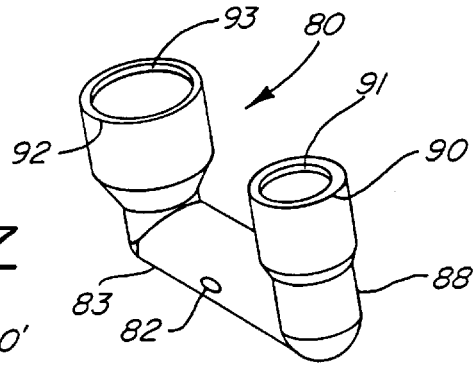
FIG-7
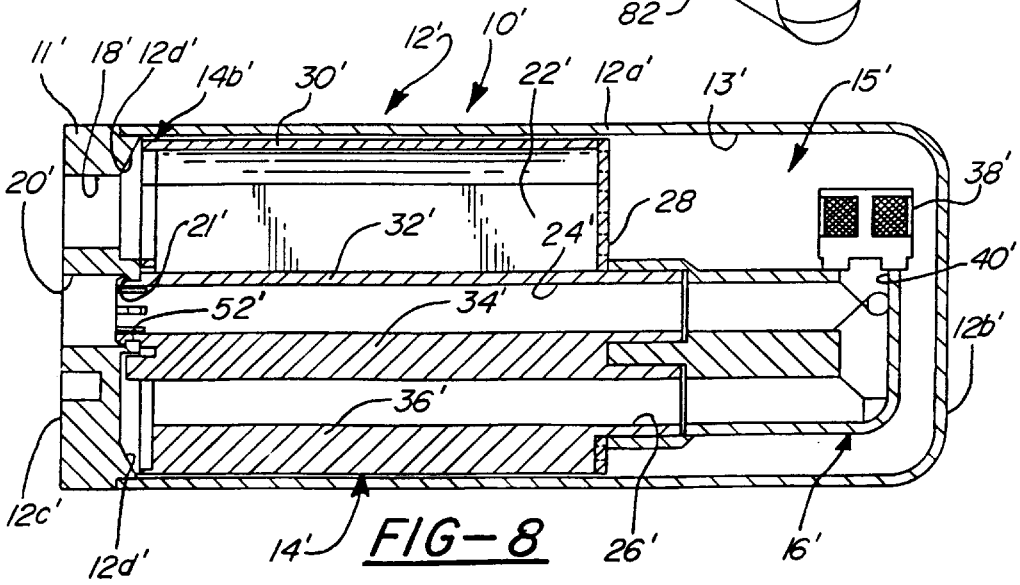
FIG-8

AIR-CONDITIONING SYSTEM ACCUMULATOR AND METHOD OF MAKING SAME

BACKGROUND OF THE INVENTION

1. Field of the Invention

The present invention relates to an accumulator device, and a method for making the accumulator device for use in air-conditioning systems and particularly for use in the air-conditioning system of an automobile.

2. Description of the Prior Art

The use of accumulators in air-conditioning systems, particularly vehicular air-conditioning systems, is well known. An accumulator is placed downstream of an evaporator, which cools the passenger compartment air as it is passed over and through the evaporator, and therefore takes in partially or completely vaporized refrigerant fluid that usually has a small amount of condensed water and a small amount of lubricating oil necessary to the functioning of the compressor. The partially vaporized refrigerant fluid entering the accumulator, being on the downstream side of the evaporator, is at a relatively low pressure, in the order of 40 psig, and at a raised but relatively low temperature, in the order of 15.6° C. (60° F.) (there being a modest temperature rise through the evaporator of about 5.6° C. (10° F.) The accumulator functions to assure that only vapor refrigerant fluid without any liquid refrigerant fluid passes to the compressor, that this vapor be moisture-free and include a prescribed amount of lubricating oil, and that the oil-laden vapor be free of particulates that might otherwise harm the compressor.

Thus, the known accumulators of the prior art basically accomplish five functions: (i) completely vaporize the refrigerant fluid, (ii) remove all water vapor from the refrigerant fluid, (iii) screen all particulates, (iv) inject a predetermined amount of lubricating oil into the outgoing refrigerant fluid vapor stream, and (v) act as a reservoir for the refrigerant fluid when air-conditioning system demand is low. Typical examples of accumulators accomplishing these functions are shown in U.S. Pat. Nos. 3,798,921; 4,111,005; 4,291,548; 4,496,378 and 5,052,193.

The major challenges in designing such an accumulator are to provide one which is efficient, one which fits well within the environment, in other words, fits within the engine compartment and is easily accessible for maintenance, and one which is inexpensive to manufacture.

Of particular interest with regard to operation efficiency, that is, ensuring only vapor refrigerant fluid is passed to the compressor, and manufacturing cost, is the design and structure of the interior parts of the accumulator. A certain degree of structural rigidity is necessary to warrant life expectancy of the accumulator and to ensure that the interior of the accumulator properly serves the purpose of separating pure vapor from liquid-laden vapor by allowing only the former to pass through to the outlet while the latter is recirculated until it is completely vaporized. In order to meet this objective, the prior art has typically used a baffle member as part of the interior of the accumulator. For example, U.S. Pat. Nos. 4,291,548 and 5,052,193 are directed towards the design of a baffle which is a separate member or component designed to be placed within the system in some convenient manner to enhance the vaporizing process.

Additionally, U.S. Pat. No. 5,075,967 issued to Bottum is directed towards a design for an accumulator having cylindrical casing end caps, an inlet passage, and an outlet passage combined within a standpipe. The inlet passage, outlet passage, and standpipe are constructed essentially of copper and are brazed to the end closures of the cylinder casing resulting in an expensive, weld-filled, heavy and less than efficient design.

U.S. Pat. No. 4,675,971 issued to Masserang shows a method of manufacturing a desiccant assembly for a refrigeration circuit. The method includes cutting a piece of seamless passage stock and friction forming one end of the passage to form an end wall. Refrigerant passages are installed in the container along with other associated components. This is expensive to manufacture and is not concerned with reducing the manufacturing costs associated with designing the interior parts of an accumulator.

As can be seen from the above, there is still a significant need for an accumulator which will accomplish the above-listed functions and which is simplified, more efficient, less costly and easier to manufacture. To this end, it would be preferable to eliminate any or all brazing in the accumulator, to eliminate expensive interior parts such as the aluminum passages, and to provide an accumulator that can be more readily adapted to a variety of environments.

SUMMARY OF THE INVENTION

The present invention pertains to a new accumulator design and method for manufacturing the same. The accumulator includes a seamless housing having inlet and outlet openings that are formed in a closed end of the housing and a one-piece cartridge which is inserted into the interior of the accumulator. The cartridge incorporates the outlet passages, the baffle member, and a means for securing the cartridge in place in the housing. The present invention further includes a method for manufacturing the above accumulator including the steps of forming a housing having an open end and a closed end; forming an inlet and an outlet hole in the closed end; making a cartridge for insertion into the housing that includes an outlet passage and a baffle member; providing means for securing the cartridge inside the housing; aligning the outlet passage of the cartridge with the outlet hole formed in the housing; and spinning shut the open end of the housing.

An alternative embodiment of the present invention embodies the same interior cartridge, a machined disk, which has the cartridge attached thereto, and a closed end housing that receives the cartridge and is welded or brazed to the disk.

It is an object of the present invention to provide an accumulator design for use in an air-conditioning system which includes a minimum number of parts, is less expensive to manufacture relative to known commercial designs, and can be manufactured using lightweight materials.

It is a further object of the present invention to simplify the accumulator housing and baffle structure to reduce the overall number of parts in the accumulator and facilitate its most efficient manufacturing and assembly.

It is a further object of the present invention to provide an accumulator having a baffle integrated within an insert in the housing.

It is yet another object of the present invention to provide a method for manufacturing an accumulator according to the present invention.

It is still a further object of the present invention to provide a method for manufacturing an accumulator wherein the housing is formed having an open end and a closed end;

an inlet and an outlet hole formed in the closed end; a cartridge for insertion in the housing that is formed to include an outlet passage and a baffle member and wherein the open end of the housing is spun shut.

It is still a further object of the present invention to provide a method for manufacturing an accumulator wherein the housing is formed having an open end, a closed end, a disk having an inlet and an outlet hole, a cartridge connected to the disk and wherein the housing is welded or brazed to the disk.

It is yet a further object of the present invention to provide a method for manufacturing an accumulator wherein the method is more simple and less costly.

It is still another object of the present invention to provide a method for manufacturing an accumulator that allows for the use of less costly components in the manufacture of the accumulator.

Another object of the present invention is to provide an accumulator, as above described, wherein all of the partially vaporized moisture-laden refrigerant fluid entering the accumulator is caused to flow through a desiccant material provided for removing moisture from the refrigerant fluid, and preferably at the first point of entering the interior chamber of the accumulator.

Another object of the present invention is to provide an accumulator, as above described, which provides a metered amount of oil into the vapor refrigerant fluid exiting the accumulator.

These above objects, features, and advantages of the present invention are readily apparent from the following detailed description of the best mode for carrying out the present invention when taken in connection with the accompanying drawings.

BRIEF DESCRIPTION OF THE DRAWINGS

FIG. 5 is a perspective view of a cartridge for use in an accumulator according to the alternative embodiment;

FIG. 7 is a perspective view of a connector used in the alternative embodiment shown in FIG. 4; and FIG. 8 is a cross-sectional view of yet another alternative embodiment of the present invention.

DETAILED DESCRIPTION OF THE PREFERRED EMBODIMENT

Figure 1:
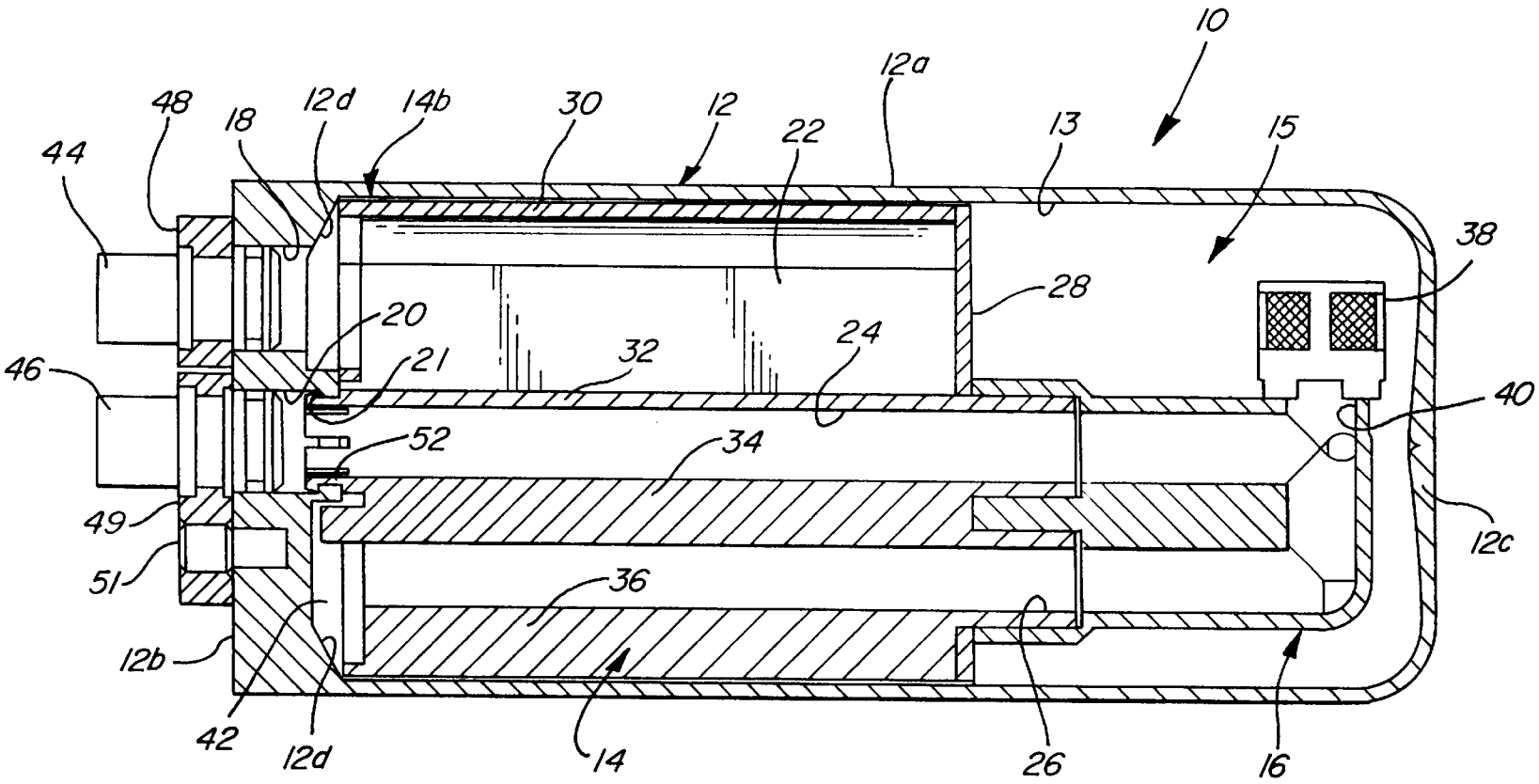
FIG. 1 is a cross-sectional view of an accumulator according to the preferred embodiment of the present invention.

With reference to the figures in general, an accumulator 10 is shown. The accumulator 10 essentially includes a housing 12, a cartridge 14, and a connector 16. The housing 12 includes an inlet hole 18 and an outlet hole 20. The cartridge 14 typically includes a first passage 22, a second passage 24, a third passage 26, and a baffle 28. The baffle 28 is best shown in FIG. 5. The first passage 22 is aligned and communicates with the inlet hole 18, and the second passage 24 is aligned and communicates with the outlet hole 20. The connector 16 is provided to connect the second passage 24 with the third passage 26 as shown in FIG. 1.

Figure 2:
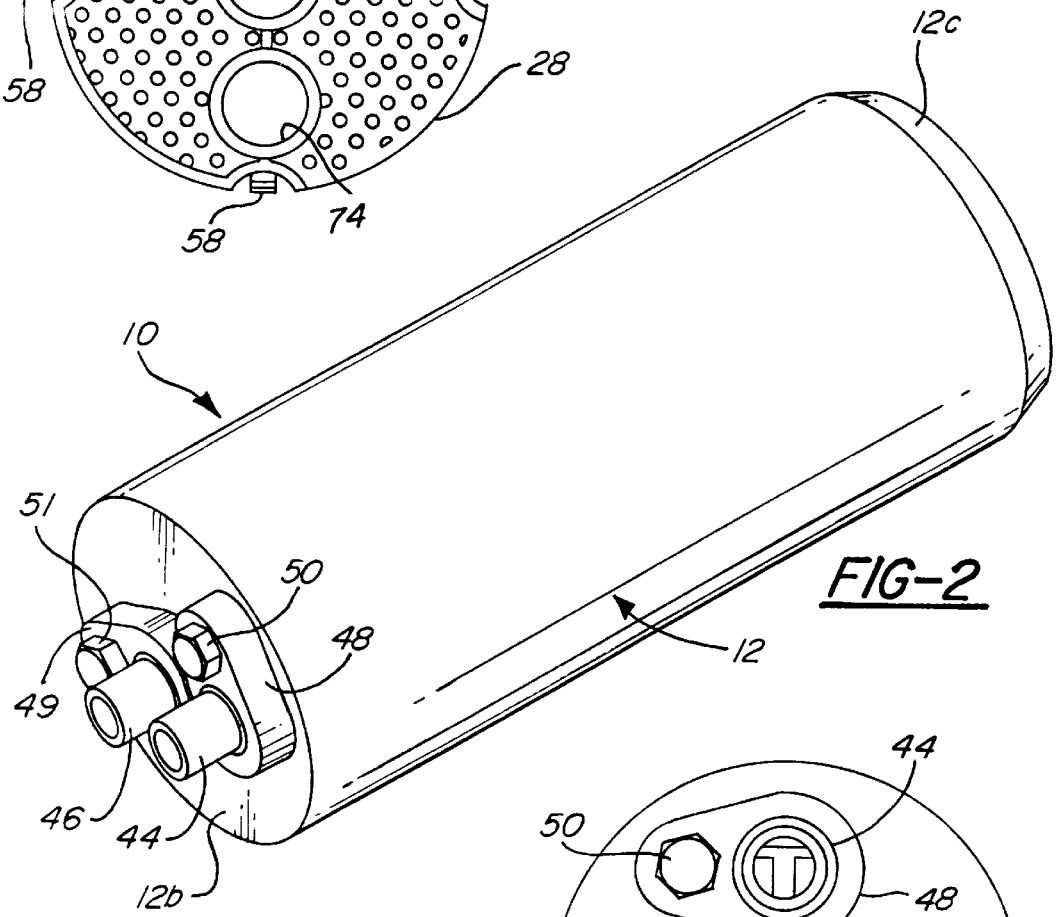
FIG. 2 is a perspective view of the exterior of an accumulator according to the preferred embodiment of the present invention.
Figure 4:
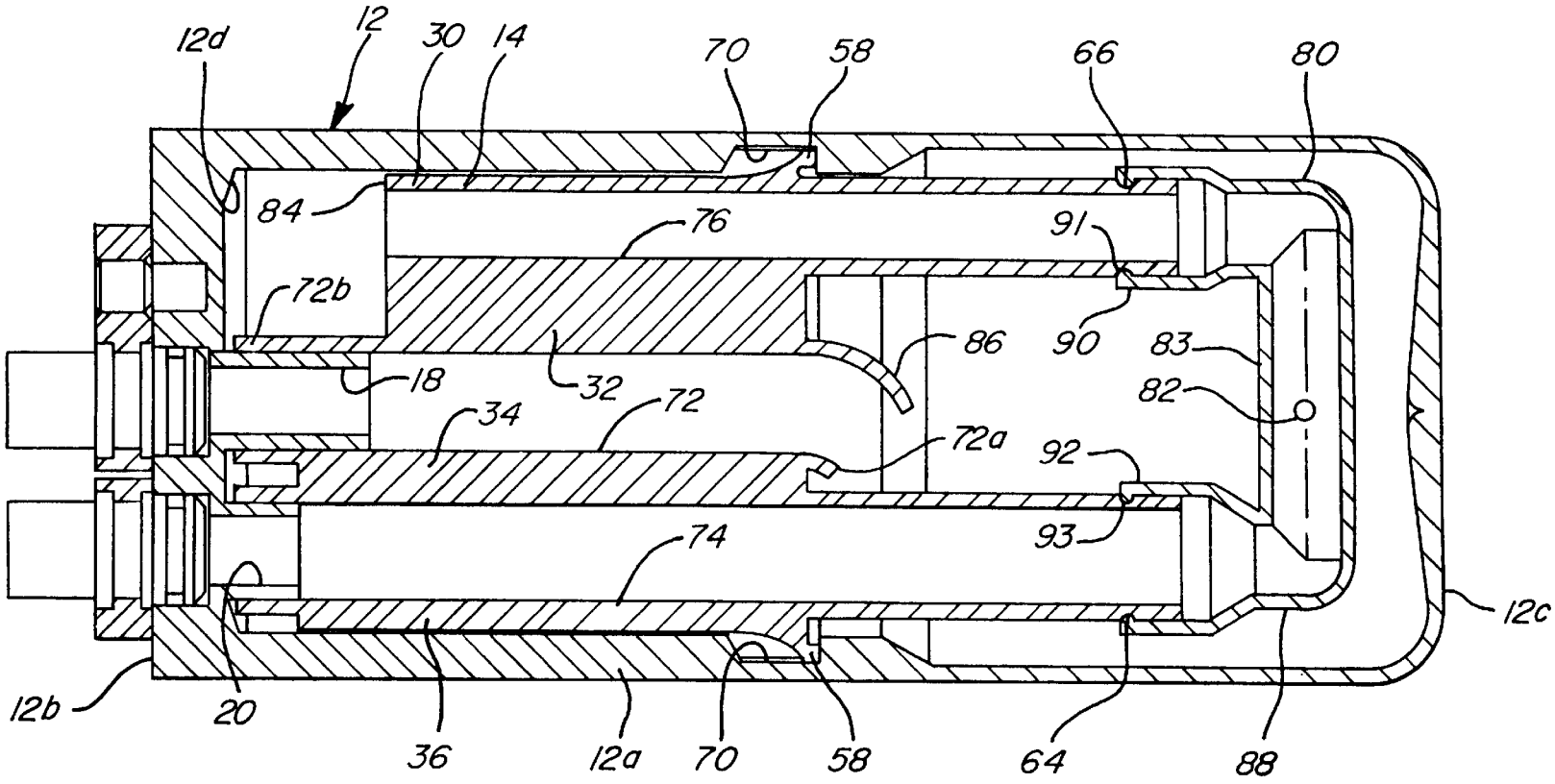
FIG. 4 is a cross-sectional view of an alternative embodiment of the present invention.

The housing 12 is shown in FIGS. 1, 2 and 4 as preferably being a seamless cylindrically-shaped object having a cylindrical side wall 12*a* which has an interior surface 13, a closed end 12*b* and an integrally open end 12*c*, which is closed during manufacturing as described later. In the preferred embodiment of FIG. 1, the interior surface 13 of the housing 12 defines an interior volume 15, and is substantially free from any defects such that a smooth interior surface 13 is preferably provided. The closed end 12*b* has located therein the inlet hole 18 and the outlet hole 20. The outlet hole 20 is aligned near the longitudinal axis of the cylindrical housing 12 and forms a passage completely through the closed end 12*b* allowing communication with the interior volume 15 of the housing 12. Similarly, the inlet hole 18 passes entirely through the closed end 12*b* of the housing 12, but is positioned at a point radially outward from the longitudinal axis of the cylindrical housing 12 in the preferred embodiment of FIG. 1.

It will be understood by those skilled in the art that it is possible to interchange or differ the positions of the inlet and outlet holes 18 and 20, depending upon the particular requirement of the vehicle in which the accumulator 10 is being used. In the alternative embodiment of FIG. 4, the inlet hole 18 is provided on the longitudinal axis of the cylindrical housing 12 whereas the outlet hole 20 is displaced a predetermined distance therefrom. Depending upon the particular cartridge 14 being used in the accumulator, the inlet and outlet holes 18 and 20 are positioned to align with the appropriate passages in the cartridge 14.

The cylindrical housing 12 can be made from any material suitable for an accumulator. Preferably, an aluminum alloy is used which is suitable for easy manufacturing and use. The cylindrical housing 12 of the accumulator of the preferred embodiment is seamless and is, therefore, very reliable in use. It is possible to produce the housing using any process such as casting or molding however, it is preferable to extrude the housing as described later herein. An alternative embodiment using a cylindrical housing 12' and a disk 11 welded to the open end 12*c'* of the housing 12' is shown in FIG. 8, further described below.

The cartridge 14 of the present invention can have various configurations but is preferably constructed as shown in FIG. 1. The cartridge 14 essentially contains the first passage 22 or inlet arrangement for allowing the incoming refrigerant fluid, oil and other substances to pass by or through the cartridge 14 and collect in the bottom or open end 12*c* of the accumulator 10; an outlet arrangement the second passage 24 and third passage 26, that is constructed to ensure that only liquid-free refrigerant fluid exits the accumulator 10; and the baffle 28 which functions to prevent liquid refrigerant fluid from reaching the outlet means.

With the above goals in mind, the cartridge 14 is preferably formed to completely cover the entire cross section of the cylindrical housing 12. This is accomplished primarily by the baffle 28 that is shown as being positioned substantially perpendicular to the passages 22, 24 and 26, depending upon the particular application and extends across the complete inside diameter of the housing.

In the preferred embodiment of FIG. 1, the cartridge includes the first passage 22 that is aligned with the inlet hole 18 in the end 12*b* of the cylindrical housing 12 and serves to convey the incoming refrigerant fluid into the bottom of the interior volume 15 of the accumulator 10. The first passage 22 is supported by the second passage 24 through a support 32. The third passage 26 is supported by the second passage 24 through a support 34. The second passage 24 and the third passage 26 of the cartridge 14 also serve to convey the refrigerant gas out of the accumulator 10.

Additionally, supports 30 and 36 are positioned between the first passage 22 and the third passage 26 and the housing 12, respectively, such that the cartridge 14 is fitted within the cylindrical housing 12 so that it will not be damaged during use.

The first, second and third passages 22, 24 and 26 are all aligned to lie in the same plane which is parallel to the longitudinal axis of the accumulator 10.

In the preferred embodiment, the first passage 22, the second passage 24, the third passage 26, and the supports 30 through 36 are all formed from the same material. Since the cartridge 14 is a one-piece unit that is supported by the cylindrical housing 12 through the support 30 and the support 36 along a fairly large contact area, the cartridge 14 is very rigid. Furthermore, since the design of the cartridge 14 is inherently rigid, a variety of materials not usable with the designs shown in the prior art can be used. This provides another way to minimize the cost of the accumulator 10, unlike the prior art design wherein separate inlet and outlet passages are required to be made of expensive metal or aluminum alloy materials and manufactured using expensive processes.

The baffle 28 covers the cross section of the housing 12 and is essentially a perforated disk (see FIG. 6) wherein the gaseous refrigerant fluid is allowed to pass through the baffle 28 and the liquid refrigerant fluid is prevented from passing by the baffle 28, such that only gaseous refrigerant fluid is allowed to exit the accumulator 10. It should be clear that by providing an insert cartridge 14 of the type disclosed herein, it is possible to use many different types of baffles not previously available.

As described above, the second and third passages 24 and 26 are part of the exit means. The third passage 26 has an end inlet portion 42 positioned near the closed end 12*b* of the cylindrical housing 12 which is provided for receiving gaseous refrigerant fluid which is to be conveyed out of the accumulator 10 and to the compressor (not shown). Accordingly, the gaseous refrigerant fluid passes through the third passage 26, which is connected to the second passage 24 via the connector 16, described below, and out of the accumulator 10 to an outlet passage 46.

The connector 16 is used as a means of communicating the refrigerant fluid from the third passage 26 to the second passage 24 of the cartridge 14. While it is possible to have the connector 16 integrally formed with the cartridge 14, it is preferable that the connector 16 be independently manufactured from the cartridge 14 and mated thereto during assembly, allowing for different connectors 16 to be used to make different length and model accumulators 10 at a lower cost.

FIG. 1 also shows an oil filter 38 connected to an orifice 40 on the connector 16. The oil filter 38 and the orifice 40 allow a measured amount of oil, which collects in the bottom of the interior volume 15 of the accumulator 10, to be drawn into the gaseous refrigerant fluid exiting the accumulator 10 for lubricating the compressor (not shown). Since the oil filter 38 is incorporated in the connector 16, a variety of oil filter 38 and orifice configurations can be used without modifying the design of the cartridge 14. The connector 16 is secured to the cartridge 14 using any suitable means such as adhesives, mechanical locks, screws, bolts, pegs or any other device.

It is also necessary to provide a means for securing the cartridge 14 in position within the cylindrical housing 12 of the accumulator 10. In the embodiment of FIG. 1, the cartridge 14 is provided with a set of clips 52 located on an end 14*b* of the cartridge 14 and positioned around the opening of the second passage 24. The clips 52 are designed to mate with an annular shoulder 21 provided in the opening of the outlet hole 20 in the closed end 12*b* of the cylindrical housing 12. The clips 52 are designed so that when the cartridge 14 is inserted in the cylindrical housing 12 during construction the clips 52 are caught by the annular shoulder 21 thereby preventing the cartridge from being removed. Additionally, the cartridge 14 is retained in position in the cylindrical housing 12 by the end 14*b* of the cartridge 14 which comes into contact with an end surface 12*d* of the cylindrical housing 12, which further defines the interior volume 15.

Figure 3:
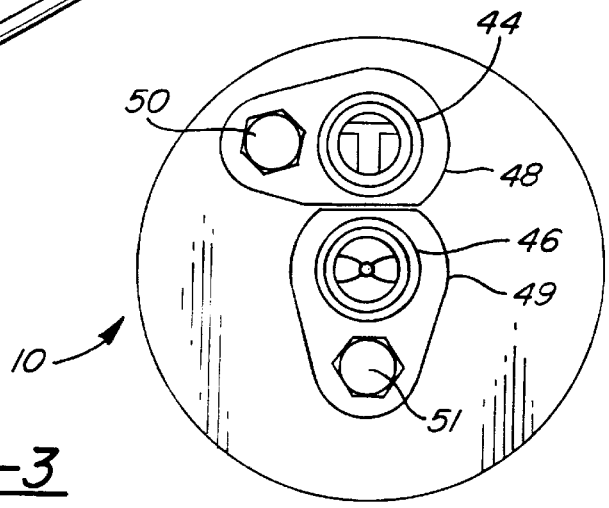
FIG. 3 is an end view of the exterior of an accumulator according to the preferred embodiment of the present invention.

FIGS. 2 and 3 depict the exterior of the accumulator 10 of FIG. 1 and, in particular, show one arrangement for connecting an inlet passage 44 and the outlet passage 46 to the accumulator 10 of the present invention. However, it should be appreciated that the accumulator 10 of the present invention can be modified to have any type of means for connecting the inlet passage 44 and the outlet passage 46 to the accumulator 10.

As can be seen in FIGS. 1 through 3, the inlet passage 44 is positioned in the inlet hole 18 that communicates with the first passage 22 of the cartridge 14. The outlet passage 46 is connected to the outlet hole 20 that communicates with the second passage 24 of the cartridge 14. The inlet passage 44 and the outlet passage 46 are each connected to the closed end 12*b* of the cylindrical housing 12 by a securing member 48 and a securing member 49, respectively. Bolts 50 and 51 secure the securing members 48 and 49, respectively, to the cylindrical housing 12. An O-ring (not shown) or other suitable sealing means can be used to provide a fluid-tight connection between the inlet passage 44 and the cylindrical housing 12 and between the outlet passage 46 and the cylindrical housing 12 as is well known in the art.

The method of manufacturing the accumulator 10 is also unique. The cylindrical housing 12 in the preferred embodiment is essentially a seamless shell which is produced in an extruding process to have one end 12*b* closed and the other end 12*c* open. The closed end 12*b* of the cylindrical housing 12 is then impacted in a cold forming operation to form the inlet hole 18 and the outlet hole 20 therein. Preferably, the holes for receiving the bolts 50 and 51 are also formed in the closed end 12*b* at the same time but may be formed using any known process. Next, the cartridge 14 is inserted into the interior of the cylindrical housing 12 and the clips 52 are engaged with the annular shoulder in the outlet hole 20. The connector 16 can be attached to the cartridge 14 before or after the cartridge 14 has been inserted in the cylindrical housing 12. Finally, the open end 12*c* of the cylindrical housing 12 is spun shut to seal the accumulator 10. Since the cylindrical housing 12 of the preferred embodiment is extruded and then spun shut, the entire cylindrical housing 12 is nearly seamless. The seamless design of the housing helps to ensure that there are no leaks, and certainly no leaks due to brazing.

The accumulator 10 is also provided with a desiccant containing member for removing any moisture which may be in the refrigerant fluid.

FIG. 5 is a perspective view of the cartridge 14 of the alternative embodiment of FIG. 4 which depicts the support 30, a first passage 72, the second support 32, a second passage 74, a third passage 76, the support 36, and the baffle 28 from FIG. 4. The cartridge 14 also includes a transverse support 54, a transverse support 56, clips 58, and an annular rib portion 60. The transverse supports 54 and 56 provide support to the cartridge 14 in a direction generally perpendicular to the supports 30 through 36. The annular rib portion 60 provides additional lateral support to the cartridge 14. The transverse support 56 has an end portion 62 that is fashioned around the clip 58. Similarly, the transverse portion 54 has an end portion 63 which is also positioned around a respective clip 58. The clips 58 are used to secure the cartridge 14 to the cylindrical housing 12.

The accumulator 10 of FIG. 4 is very similar to the accumulator of FIG. 1. However the means for securing the cartridge 14 to the cylindrical housing 2 is quite different. Instead of the clips 52 of FIG. 1 an annular indentation 70 is formed in the side wall 12*a* of the cylindrical housing 12 for receiving the clips 58 and to connect the cartridge 14 to the cylindrical housing 12. The first passage 72 is aligned parallel to the third passage 76 and is connected therebetween by a web support 32 similar to the embodiment of FIG. 1. The second passage 74 is shown connected to the outlet hole 20 which in the present embodiment extends further into the cylindrical housing 12 and is received within the second passage 74 of the cartridge 14. Similarly, the inlet hole 18 also extends further into the cylindrical housing 12 and is received within the first passage 72. The first passage 72 has a contoured end 72*a* which causes the incoming partially vaporized refrigerant fluid to circulate within the interior volume 15 of the cylindrical housing 12 below the baffle member 28. In the embodiment of FIGS. 4 and 5, the first passage 72, the second passage 74, and the third passage 76 are positioned so that their functions are the same as in FIG. 1. Thus, the first passage 72 still serves as an inlet passage to convey the incoming refrigerant fluid past the baffle 28 and the second and third passages 74 and 76 still function to outlet the gaseous refrigerant once it passes through the baffle 28 and enters an opening 84 of the third passage 76 near the end surface 12*d* of the cylindrical housing 12.

In the embodiment of FIG. 4, the second and third passages 74 and 76 are separated by the first passage 72. A connector 80 is provided which is essentially a U-shaped passage for connecting the second and third passages 74 and 76 for completing the exit path. The connector 80 has an oil orifice 82 in the bight portion 83 thereof for entraining oil, which collects in the accumulator, in the refrigerant gas leaving the accumulator 10 via the exit passage. The inlet of the first passage 72 has a first or top end 72*b* that has the inlet hole 18 and its associated structure located therein for conveying the incoming refrigerant fluid into the interior volume of the accumulator 10. The refrigerant fluid entering the accumulator 10 via the first passage 72 collects in the bottom of the accumulator 10 below the baffle member 28. The refrigerant fluid exits the inlet passage 72 at the end 72*a* preferably below the baffle member 28.

The connector 80 of the embodiment of FIG. 4 is best shown in FIG. 7. The connector generally includes the bight portion 83 and a leg segment 88 that can be varied to produce different size connectors 80 for use in different size accumulators 10. A first end 90 of the leg segment 88 has an inwardly projecting annular ridge 91 and a second end 92 of the leg segment 88 has an inwardly extending annular ridge 93 that are used to engage the connector 80 around the third and second passages 76 and 74, respectively, of the cartridge 14. The second passage 74 and the third passage 76 each have an annular detent 64 and 66, respectively, for receiving the annular ridges 93 and 91, respectively, of the connector 80.

While the embodiment illustrated in FIG. 4 is of slightly different configuration than that shown in FIG. 1, the general features of the present invention are retained. In both embodiments, the cartridge 14 is preferably formed from one piece of material as a completely integral unit. The connectors 16 and 80, in both embodiments, can either be integrally formed with the cartridge 14 or separately formed to provide design flexibility in the production of different size accumulators 10.

Figure 6:
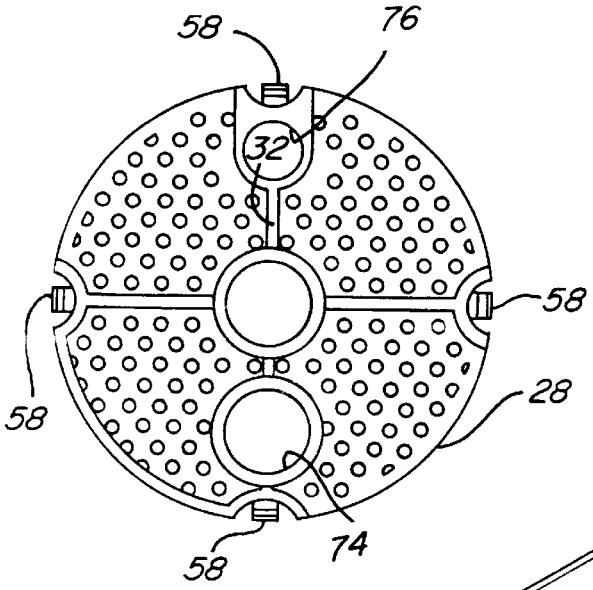
FIG. 6 is a cross-sectional view taken in the direction of the arrows 6—6 of the cartridge shown in FIG. 5.

FIG. 6 is a plan view of the baffle 28 of the cartridge 14 of the embodiment shown in FIGS. 4 and 5. The first passage 72, the second passage 74, and the third passage 76 are shown intersecting the baffle 28. With the exception of the first passage 72, the second passage 74, and the third passage 76, the baffle 28 generally covers the complete cross section of the cylindrical housing 12 and divides the cylindrical housing 12 into an upper portion and a lower portion. The baffle 28 is designed to allow the completely vaporized refrigerant fluid to pass therethrough and to prevent partially vaporized refrigerant fluid from passing to the second passage 74. Additionally, since the baffle 28 covers the complete cross section of the cylindrical housing 12, the baffle 28 provides additional structural stability to the cartridge 14. The additional structure provided by the baffle 28 allows the cartridge 14 to be constructed from lightweight materials such as plastic, greatly reducing the overall weight of the accumulator 10. The ability to use plastic to manufacture the cartridge 14 allows for a variety of production methods not previously available in conventional metal passage accumulators which serves to significantly reduce production costs.

As previously discussed above, the alternative embodiment of FIG. 8 shows the use of the cartridge 14 in conjunction with a housing 12' which utilizes an end cap or disk 11 to close the end 12*c'* of the housing 12'. Components shown in FIG. 8 that are the same as components in FIG. 1 have similar reference characters designated by ('). The accumulator 10' of the alternative embodiment shown in FIG. 8 is produced using a unique method. First, the housing 12' is produced in an extruding process to have an end 12*b'*, that is closed, and an end 12*c'*, that is initially open. Second, the end cap or disk 11 is manufactured using any known process and has an inlet hole 18' and an outlet hole 20' for connecting to the hoses of the air-conditioning circuit. The disk is manufactured to meet with the end 12*c'* of the housing 12' in order to align therewith and provide an adequate closure to the end 12*c'* of the housing 12'.

In manufacturing the accumulator 10' of the alternative embodiment as shown in FIG. 8, it is possible to have the cartridge 14' first inserted within the housing 12' or to have the cartridge 14' first connected to the disk 11. In the former, the cartridge 14', with the end cap 16' connected or integral therewith, is first inserted within the housing 12' until it is locked in place. In the latter, the cartridge 14' is first connected to the disk 11 and then the cartridge 14' is inserted in the housing 12' until the disk 11 is aligned with the end 12*c'* of the housing 12', as shown in FIG. 8.

While the cartridge 14' is inserted within the housing 12', as described above using either method, the inlet hole 18' and the outlet hole 20' are aligned with the respective passages of the cartridge 14'. Once the cartridge 14' is completely inserted within the housing 12' and the end cap or disk 11 is positioned on the end 12*c'* of the housing 12', the disk 11 is welded or brazed to the end 12*c'* of the housing 12' in order to provide a seal therebetween. It should be noted that it is possible to use any known method for sealing the disk 11 to the housing 12'. It should also be noted that the other details with respect to the other embodiments apply to the embodiment of FIG. 8, except where the specific differences have been noted.

While the present invention has been illustrated in the accompanying drawings and described in the foregoing description with particular specifics, it is to be understood that the present invention is not to be limited to just the embodiments disclosed herein. Numerous rearrangements, modifications and substitutions are possible without departing from the scope of the following claims.

What is claimed is:

1. An accumulator for use in an air-conditioning system, said accumulator comprising:

a housing defining an internal chamber, said housing including a first end having an inlet hole and an outlet hole therethrough; and a cartridge comprising a first passage having a bottom end and a top end, said top end of said first passage aligned and communicating with said inlet hole of said first end of said housing, a second passage having a bottom end and a top end, said top end of said second passage aligned and communicating with said outlet hole of said first end of said housing, and a third passage having a bottom end and a top end, said top end of said third passage open to said internal chamber of said housing.

2. The accumulator of claim 1 further comprising:

means for connecting said second passage to said third passage; and means for securing said cartridge within said internal chamber of said housing.

3. The accumulator of claim 2 wherein said means for securing said cartridge to said housing comprises at least one clip attached to said cartridge and a shoulder integral with said housing for receiving said at least one clip.

4. The accumulator of claim 2 wherein said means for connecting said second passage to said third passage is integrally formed with said cartridge.

5. The accumulator of claim 2 wherein said means for connecting said second passage to said third passage includes an oil pick-up orifice for adding a metered amount of oil into a refrigerant fluid exiting said accumulator.

6. The accumulator of claim 5 further comprising an oil filter connected to said oil pick-up orifice of said means for connecting said second passage to said third passage.

7. The accumulator of claim 1, wherein said cartridge further comprises a baffle member integral with said cartridge and dividing said internal chamber into an upper portion and a lower portion, said baffle member having a perforate surface such that an incoming partially vaporized refrigerant fluid circulates within said lower portion of said internal chamber until said incoming partially vaporized refrigerant fluid is completely vaporized such that a completely vaporized refrigerant fluid passes through said baffle member into said upper portion of said internal chamber in said top end of said third passage of said cartridge and is conveyed to said outlet hole in said first end of said housing.

8. The accumulator of claim 7 wherein said baffle member is connected to and integral with said first, second, and third passages between said top ends and said bottom ends of said passages.

9. The accumulator of claim 1 further comprising a desiccant-containing member for removing moisture from a refrigerant fluid circulated within said accumulator.

10. A method for manufacturing an accumulator, said method comprising the steps of:

forming a housing having an open end and a closed end;

forming an inlet hole and an outlet hole in said closed end of said housing;

making a cartridge having a first passage, a second passage, a third passage, and a baffle member;

inserting said cartridge in said housing;

aligning, simultaneous with said inserting step, said first passage with said inlet hole of said housing and said second passage of said cartridge with said outlet hole of said housing; and closing said open end of said housing after said step of inserting said cartridge in said housing.

11. The method of claim 10 wherein said step of forming a housing having an open and a closed end comprises the steps of:

extruding a predetermined length of housing having a circular cross section; and forming said extruded housing with a closed end.

12. The method of claim 10 wherein said step of forming said inlet and outlet holes comprises the step of:

impacting said closed end of said housing in a cold heading process to form said inlet and said outlet holes.

13. The method of claim 10 wherein said step of making said cartridge further comprises the step of connecting said second passage to said third passage.

14. The method of claim 10 further comprising the step of securing said cartridge within said housing after the steps of inserting and aligning said cartridge within said housing.

15. The method of claim 10 wherein said step of closing said open end of said housing comprises the step of spin-closing shut said open end of said housing.

16. An accumulator for use in an air-conditioning system, said accumulator comprising:

a housing defining an internal chamber, said housing having a first end;

an end cap connected to said first end of said housing, said end cap including an inlet hole and an outlet hole therein;

a cartridge comprising a first passage having a bottom end and a top end, said top end of said first passage aligned and communicating with said inlet hole of said end cap, a second passage having a bottom end and a top end, said top end of said second passage aligned and communicating with said outlet hole of said end cap, and a third passage having a bottom end and a top end, said top end of said third passage being open to said internal chamber of said housing.

17. The accumulator of claim 16 further comprising:

means for connecting said second passage to said third passage; and means for securing said cartridge within said internal chamber of said housing.

18. The accumulator of claim 17 wherein said means for securing said cartridge to said housing comprises at least one clip attached to said cartridge and a shoulder integral with said end cap for receiving said at least one clip.

19. The accumulator of claim 17, wherein said connecting means is integrally formed with said cartridge.

20. The accumulator of claim 17 wherein said means for connecting said second passage to said third passage includes an oil pick-up orifice for adding a metered amount of oil into a refrigerant gas passing through said connecting means.

21. The accumulator of claim 20 further comprising an oil filter connected to said oil pick-up orifice of said means for connecting said second passage to said third passage.

22. The accumulator of claim 16, wherein said cartridge further comprises a baffle member integral with said cartridge, said baffle member dividing said internal chamber into an upper portion and a lower portion, said baffle member having a perforate surface such that an incoming partially vaporized refrigerant fluid circulates within said lower portion of said internal chamber until said incoming partially vaporized refrigerant fluid is completely vaporized whereby a completely vaporized refrigerant fluid passes through said baffle member into said upper portion of said internal chamber in said top end of said third passage of said cartridge.

23. The accumulator of claim 22 wherein said baffle member is connected to and integral with said first, second, and third passages between said top ends and said bottom ends of said passages.

24. The accumulator of claim 16 further comprising a desiccant-containing member for removing moisture from a refrigerant fluid circulated within said accumulator.

25. A method for manufacturing an accumulator, said method comprising the steps of:

forming a housing having an open end and a closed end;

forming an end cap having an inlet hole and an outlet hole;

forming a cartridge having a first passage, a second passage, a third passage, and a baffle member;

securing said cartridge to said end cap;

aligning, simultaneous with said step of securing said cartridge to said end cap, said first passage with said inlet hole of said end cap and said second passage of said cartridge with said outlet hole of said end cap; and inserting said cartridge in said housing such that said end cap closes said open end of said housing; and sealing said end cap to said housing after said step of inserting said cartridge in said housing.

26. The method of claim 25 wherein said step of forming a housing having said open and said closed end comprises the steps of:

extruding a predetermined length of housing having a circular cross section; and forming a closed end in said extruded housing.

27. The method of claim 26 wherein said step of securing said end cap to said housing comprises the step of brazing said end cap to said open end of said housing.

28. The method of claim 25 wherein said step of forming said cartridge further comprises the step of connecting said second passage to said third passage.

29. The method of claim 25 wherein said step of securing said end cap to said housing comprises the step of welding said end cap to said open end of said housing.

* * * * *

UNITED STATES PATENT AND TRADEMARK OFFICE

CERTIFICATE OF CORRECTION

PATENT NO. : 6,125,651
DATED : October 3, 2000
INVENTOR(S) : Tack et al.

It is certified that error appears in the above-identified patent and that said Letters Patent is hereby corrected as shown below:

Column 4,
Line 40, after "molding" insert a comma -- , --.
Line 51, after "arrangement" insert a comma -- , --.

Column 7,
Line 13, after "However" insert a comma -- , --.
Line 14, delete "2" and insert -- 12 --.

Column 8,
Line 51, delete "16'" and insert -- 11 --.

Signed and Sealed this

Sixth Day of November, 2001

*Attest:*

Nicholas P. Godici

*Attesting Officer*

NICHOLAS P. GODICI
*Acting Director of the United States Patent and Trademark Office*